US009504362B1

(12) United States Patent
Skinner

(10) Patent No.: US 9,504,362 B1
(45) Date of Patent: Nov. 29, 2016

(54) HEAD TOWEL CAP

(71) Applicant: Veronique Skinner, Desoto, TX (US)

(72) Inventor: Veronique Skinner, Desoto, TX (US)

( * ) Notice: Subject to any disclaimer, the term of this patent is extended or adjusted under 35 U.S.C. 154(b) by 0 days.

(21) Appl. No.: 14/821,443

(22) Filed: Aug. 7, 2015

(51) Int. Cl.
*F26B 5/00* (2006.01)
*A47K 10/02* (2006.01)
*A42B 1/04* (2006.01)

(52) U.S. Cl.
CPC *A47K 10/02* (2013.01); *A42B 1/04* (2013.01)

(58) Field of Classification Search
CPC ..... F26B 3/00; F26B 5/00; F26B 11/00; A42B 1/04; A42B 1/06
USPC ..... 34/90, 104, 105; 2/88, 171, 174
See application file for complete search history.

(56) References Cited

U.S. PATENT DOCUMENTS 2,107,951 A * 2/1938 Lipton ..... A42B 1/041 2/171.5
2,524,775 A * 10/1950 De Grazia ..... A42B 1/045 2/204
2,709,261 A * 5/1955 Kalensky ..... A42B 1/041 2/195.1
2,767,404 A * 10/1956 Collins ..... A42B 7/00 2/171
5,062,157 A 11/1991 Muta
5,249,308 A 10/1993 Blume
5,293,646 A 3/1994 Winston
6,738,986 B1 * 5/2004 Martin ..... A42B 1/241 2/171
D543,013 S * 5/2007 Robinson, III ..... D2/881
7,337,475 B1 * 3/2008 Wood ..... A42B 1/067 2/202
7,467,423 B1 * 12/2008 Tawfik ..... A41D 23/00 2/207
7,827,621 B2 * 11/2010 DaCruz ..... A45D 20/00 132/212
7,930,768 B1 * 4/2011 Tyler ..... A42B 1/041 2/173
2009/0205108 A1 * 8/2009 Ross ..... A42B 1/067 2/172
2014/0013485 A1 * 1/2014 Parker ..... A42B 1/067 2/172

* cited by examiner

*Primary Examiner* — Stephen M Gravini
(74) *Attorney, Agent, or Firm* — Crossley & Stevenson Intellectual Property Law

(57) ABSTRACT

A head towel cap including an elasticized circular cap having a front area, a back area, a right area, and a left area. A V-shaped attachment has a substantially rectangular right flap, a substantially rectangular left flap, and a concave apex continuously attached to the back area of the cap. The cap and the attachment is an absorptive material. A pair of hook and loop fasteners includes a right hook fastener and a left hook fastener. The right hook fastener is disposed on an exterior surface of the right flap proximal the bottom edge, and the left hook fastener is disposed on an exterior surface of the left flap proximal the bottom edge.

3 Claims, 3 Drawing Sheets

HEAD TOWEL CAP

BACKGROUND OF THE INVENTION

Various types of head caps and towels are known in the prior art. However, what has been needed is a head towel cap including an elasticized substantially circular cap configured to cover a user's head, a V-shaped attachment having a right flap, a left flap, and a concave apex attached to a back area of the cap, and a right hook fastener and a left hook fastener disposed on an exterior surface of the left flap proximal a bottom edge and the right flap proximal the bottom edge, respectively. What has been further needed is for each of the right flap and the left flap to have a folded position and an alternate unfolded position. Each of the right flap and the left flap is in the retracted position when each of the right flap and the left flap is secured to an external surface of a left area of the cap and a right area of the cap, respectively. Each of the right flap and the left flap is in the extended position when the bottom edge of each of the right flap and the left flap is disposed atop a right breast and a left breast, respectively. The head towel cap thus protects a user's clothes from becoming wet or dirty from water, hair coloring, and hair trimmings. The retractable and extendable nature of the right flap and the left flap allows the head towel cap to be individually used as a towel and, alternately, a hair cap, as needed.

FIELD OF THE INVENTION

The present invention relates to towels and head caps, and more particularly, to a head towel cap.

SUMMARY OF THE INVENTION

The general purpose of the present head towel cap, described subsequently in greater detail, is to provide a head towel cap which has many novel features that result in a head towel cap which is not anticipated, rendered obvious, suggested, or even implied by prior art, either alone or in combination thereof.

To accomplish this, the present head towel cap includes an elasticized substantially circular cap having a front area, a back area, a right area, and a left area. Each of the front area, the back area, the right area, and the left area has an internal surface and an external surface. The cap is configured to cover a head of a user. A V-shaped attachment has a substantially rectangular right flap, a substantially rectangular left flap, and a concave apex continuously attached to the back area of the cap. Each of the right flap and the left flap has an interior surface, an exterior surface, and a bottom edge. The cap and the attachment is an absorptive material.

A pair of hook and loop fasteners includes a right hook fastener and a left hook fastener. The right hook fastener is disposed on the exterior surface of the right flap proximal the bottom edge, and the left hook fastener is disposed on the exterior surface of the left flap proximal the bottom edge. Each of the right hook fastener and the left hook fastener is configured to selectively secure the right flap and the left flap, respectively, to the external surface of the left area of the cap proximal the front area and the external surface of the right area of the cap proximal the front area, respectively. Each of the right flap and the left flap has a folded position and an alternate unfolded position. Each of the right flap and the left flap is in the folded position when each of the right flap and the left flap is secured to the external surface of the left area of the cap proximal the front area and the external surface of the right area of the cap proximal the front area, respectively. Each of the right flap and the left flap is in the unfolded position when the bottom edge of each of the right flap and the left flap is disposed atop a right breast and a left breast, respectively, of a user. Each of the right flap and the left flap has an optional length in a range of nine inches to thirteen inches and an optional width in a range of one inch to two inches.

Thus has been broadly outlined the more important features of the present head towel cap so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

With reference now to the drawings, and in particular FIGS. 1 through 5 thereof, an example of the instant head towel cap employing the principles and concepts of the present head towel cap and generally designated by the reference number 10 will be described.

Figure 1:
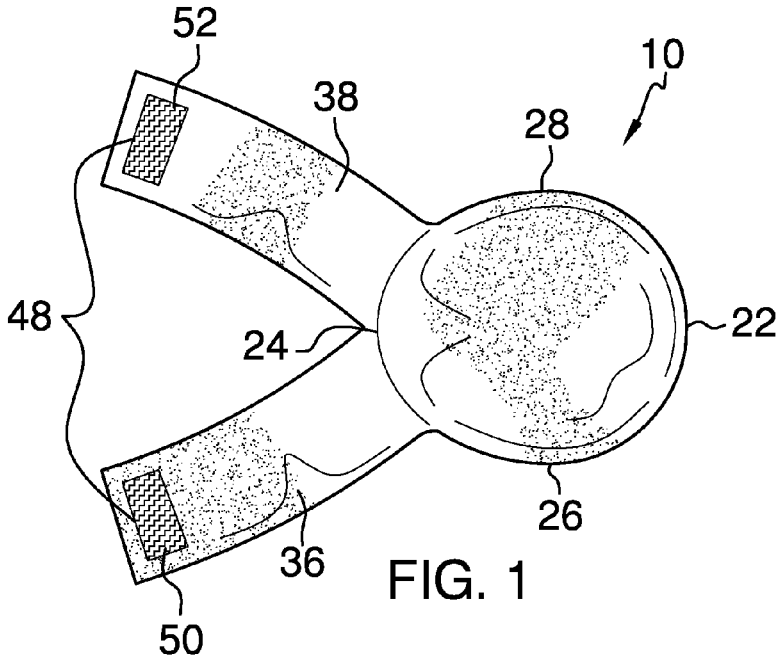
FIG. 1 is a top plan view.
Figure 2:
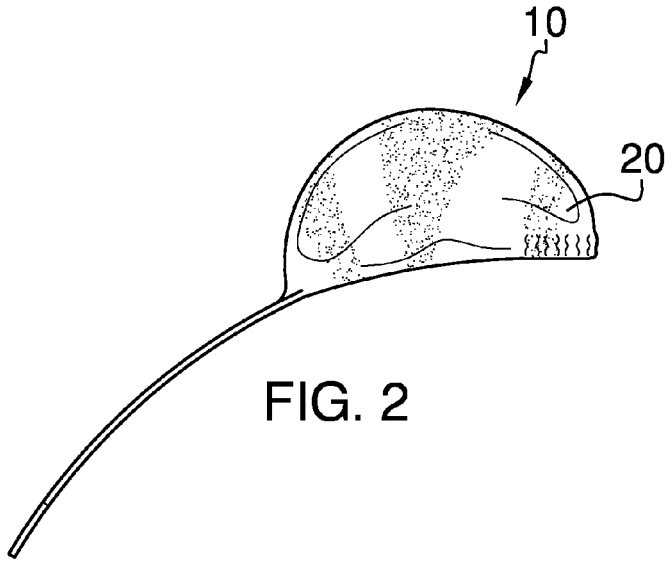
FIG. 2 is a side elevation view.
Figure 3:
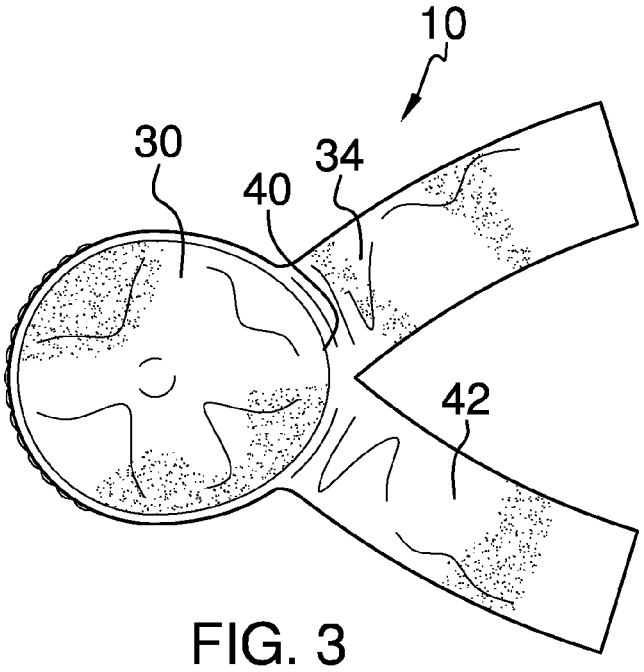
FIG. 3 is a bottom plan view.
Figure 4:
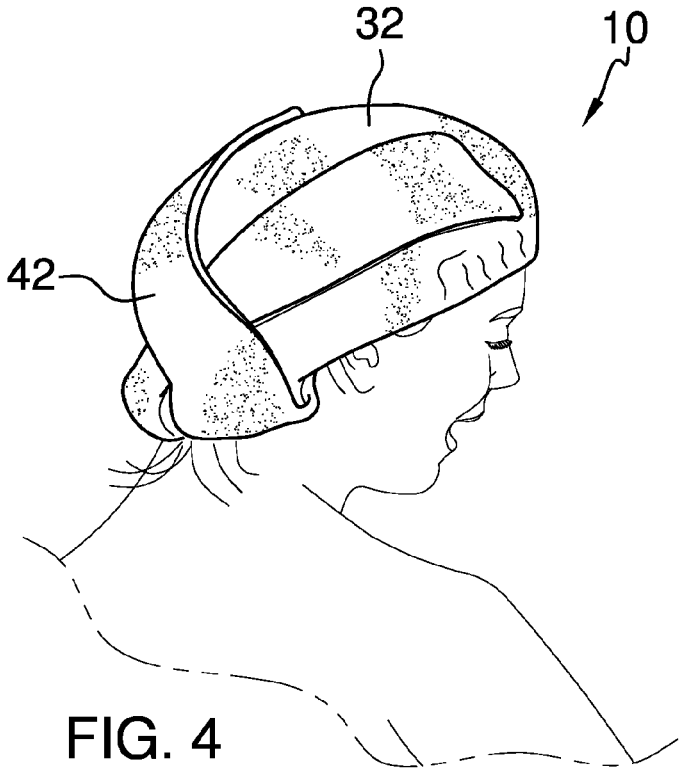
FIG. 4 is an in-use view showing each of a right flap and a left flap in a folded position.

Referring to FIGS. 1 through 5 the present head towel cap 10 is illustrated. The head towel cap 10 includes an elasticized substantially circular cap 20 having a front area 22, a back area 24, a right area 26, and a left area 28. Each of the front area 22, the back area 24, the right area 26, and the left area 28 has an internal surface 30 and an external surface 32. As best shown in FIG. 4, the cap 20 is configured to cover a head of a user. A V-shaped attachment 34 has a substantially rectangular right flap 36, a substantially rectangular left flap 38, and a concave apex 40 continuously attached to the back area 24 of the cap 20. Each of the right flap 36 and the left flap 38 has an interior surface 42, an exterior surface 44, and a bottom edge 46.

Figure 5:
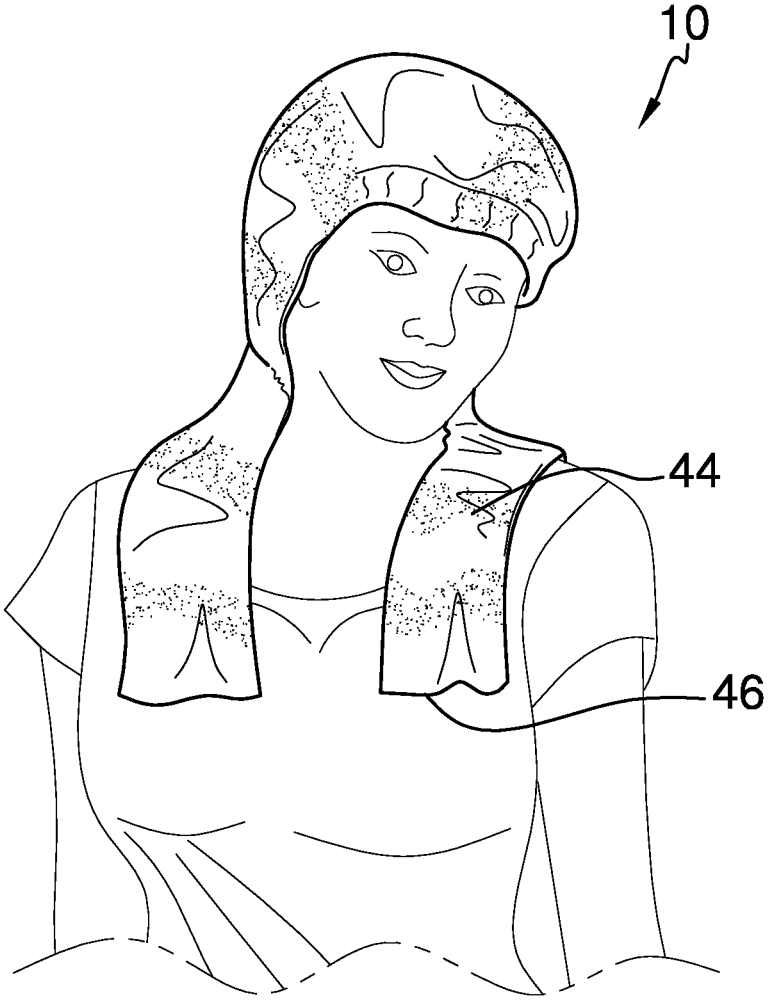
FIG. 5 is an in-use view showing each of the right flap and the left flap in an unfolded position.

A pair of hook and loop fasteners 48 includes a right hook fastener 50 and a left hook fastener 52. The right hook fastener 50 is disposed on the exterior surface 44 of the right flap 36 proximal the bottom edge 46, and the left hook fastener 52 is disposed on the exterior surface 44 of the left flap 38 proximal the bottom edge 46. As best shown in FIG. 4, each of the right hook fastener 50 and the left hook fastener 52 is configured to selectively secure the right flap 36 and the left flap 38, respectively, to the external surface 32 of the left area 28 of the cap 20 proximal the front area 22 and the external surface 32 of the right area 26 of the cap 20 proximal the front area 22, respectively. Each of the right flap 36 and the left flap 38 has a folded position and an alternate unfolded position. Each of the right flap 36 and the left flap 38 is in the folded position when each of the right flap 36 and the left flap 38 is secured to the external surface 32 of the left area 28 of the cap 20 proximal the front area 22 and the external surface 32 of the right area 26 of the cap 20 proximal the front area 22, respectively. As best shown in FIG. 5, each of the right flap 36 and the left flap 38 is in the unfolded position when the bottom edge 46 of each of the right flap 36 and the left flap 38 is disposed atop a right breast and a left breast, respectively, of a user.

What is claimed is:

1. A head towel cap comprising:

an elasticized substantially circular cap having a front area, a back area, a right area, and a left area, each of the front area, the back area, the right area, and the left area having an internal surface and an external surface;

wherein the cap is configured to cover a head of a user;

a V-shaped attachment having a substantially rectangular right flap, a substantially rectangular left flap, and a concave apex continuously attached to the cap back area, each of the right flap and the left flap having an interior surface, an exterior surface, and a bottom edge;

wherein the cap and the attachment is an absorptive material; and a pair of hook fasteners comprising a right hook fastener and a left hook fastener, wherein the right hook fastener is disposed on the exterior surface of the right flap proximal the bottom edge, and the left hook fastener is disposed on the exterior surface of the left flap proximal the bottom edge, wherein each of the right hook fastener and the left hook fastener is configured to selectively secure the right flap and the left flap, respectively, to the external surface of the cap left area proximal the front area and the external surface of the cap right area proximal the front area, respectively;

wherein each of the right flap and the left flap has a folded position and an alternate unfolded position;

wherein each of the right flap and the left flap is in the folded position when each of the right flap and the left flap is secured to the external surface of the cap left area proximal the front area and the external surface of the cap right area proximal the front area, respectively;

wherein each of the right flap and the left flap is in the unfolded position when the bottom edge of each of the right flap and the left flap is disposed atop a right breast and a left breast, respectively, of a user.

2. The head towel cap of claim 1 wherein each of the right flap and the left flap has a length in a range of nine inches to thirteen inches.

3. The head towel cap of claim 2 wherein each of the right flap and the left flap has a width in a range of one inch to two inches.

* * * * *